US012599211B1

(12) United States Patent
Ceballos

(10) Patent No.: US 12,599,211 B1
(45) Date of Patent: Apr. 14, 2026

(54) CARRYING CASE HAVING TIMED LOCKING ASSEMBLIES TO STORE PHONES

(71) Applicant: Yenny M. Ceballos, Miami, FL (US)

(72) Inventor: Yenny M. Ceballos, Miami, FL (US)

( * ) Notice: Subject to any disclaimer, the term of this patent is extended or adjusted under 35 U.S.C. 154(b) by 34 days.

(21) Appl. No.: 18/813,991

(22) Filed: Aug. 23, 2024

(51) Int. Cl.
*A45C 13/10* (2006.01)
*A45C 3/06* (2006.01)
*A45C 11/00* (2006.01)
*A45C 15/00* (2006.01)

(52) U.S. Cl.
CPC ..... *A45C 13/103* (2013.01); *A45C 3/06* (2013.01); *A45C 15/00* (2013.01); *A45C 11/002* (2025.01)

(58) Field of Classification Search
CPC ..... A45C 13/103; A45C 3/06; A45C 15/00; A45C 11/002
USPC ..... 70/68
See application file for complete search history.

(56) References Cited

U.S. PATENT DOCUMENTS 9,545,134 B1 * 1/2017 Tan ..... A44B 19/262
11,202,490 B1 * 12/2021 Lloyd ..... A45C 13/103
11,617,424 B2 * 4/2023 Detry ..... A44B 19/301 70/68
2012/0073714 A1 * 3/2012 Hai ..... A45C 13/30 150/101
2012/0103481 A1 * 5/2012 Nieves ..... A45C 13/10 150/113
2017/0130951 A1 * 5/2017 Carrasco-Slind ... F21V 33/0004

FOREIGN PATENT DOCUMENTS

WO WO-2008029380 A1 * 3/2008 ..... A44C 17/0258

* cited by examiner

*Primary Examiner* — Nathan Cumar
(74) *Attorney, Agent, or Firm* — Albert Bordas, Esq.

(57) ABSTRACT

A carrying case having timed locking assemblies to store phones, which has a case assembly, a locking assembly, and at least one zipper assembly integrated to the lock assembly. The zipper assembly and the locking assembly are part of the case assembly. The locking assembly has a front face, a top face, and lateral faces. The front face has an screen, buttons, a reset button, a lower end, a locking pin, and an upper end. The top face has a locking tab. The locking pin is retractable and is actuated automatically and manually. The screen shows a time, which is programed by the buttons. The zipper assembly has a zipper tape, teeth, and an slider having a pull tab with a pull tab hole. The case assembly stores a cell phone. The zipper assembly with the locking assembly in a locked configuration restrict the access to the cell phone.

11 Claims, 5 Drawing Sheets

CARRYING CASE HAVING TIMED LOCKING ASSEMBLIES TO STORE PHONES

BACKGROUND OF THE INVENTION

Field of the Invention

The present invention relates to cases having locking systems, and more particularly, to a carrying case having timed locking assemblies to store phones.

Description of the Related Art

Applicant is not aware of any carrying case having timed locking assemblies to store phones having the novel features of the present invention.

SUMMARY OF THE INVENTION

The present invention is a carrying case having timed locking assemblies to store phones comprising a case assembly, a locking assembly, and at least one zipper assembly integrated to the lock assembly.

The zipper assembly and the locking assembly are part of the case assembly.

The locking assembly comprises a front face, a top face, and first and second lateral faces. The front face comprises an screen, buttons, a reset button, a lower end, a locking pin, and an upper end. The top face comprises a locking tab.

The locking pin is retractable and extends from the lower end to the upper end. The locking pin is actuated automatically and manually.

The lower end and the upper end with the locking pin are positioned close to the second lateral face. The first lateral face comprises a loop.

The screen displays a time or a timer, which is programed by the buttons.

The zipper assembly comprises a zipper tape, teeth, and an slider having a pull tab with a pull tab hole.

The locking assembly is attached in line to the zipper tape to receive the pull tab.

In a locked configuration the locking pin passes through the pull tab hole and the upper end receives the locking pin securing the pull tab on the locking assembly.

In an unlocked configuration the locking pin is open toward the lower end releasing the pull tab.

The locking pin is actuated by the locking tab. A predetermined time to keep the zipper assembly in the locked configuration is scheduled through the buttons.

The locking pin releases automatically the pull tab when the predetermined time is completed.

The pull tab is manually released through the locking tab when desires.

The case assembly stores a cell phone. The zipper assembly with the locking assembly in the locked configuration restrict the access to the cell phone inside a case.

The locking assembly comprises a first zipper assembly connected to the loop at the first lateral face and a second zipper assembly extending from the second lateral face, whereby both of the first and second zipper assemblies are locked by the locking assembly.

It is therefore one of the main objects of the present invention to provide a carrying case having timed locking assemblies to store phones.

It is another object of this invention to provide a carrying case having timed locking assemblies to store phones in which the locking assembly is integrated to a zipper of the case.

It is therefore one of the main objects of the present invention to provide a carrying case having timed locking assemblies to store phones, which helps people avoid contact with their cell phone for a predetermined time.

It is another object of this invention to provide a carrying case having timed locking assemblies to store phones that is volumetrically efficient for carrying, transporting, and storage.

It is another object of this invention to provide a carrying case having timed locking assemblies to store phones that can be readily assembled and disassembled without the need of any special tools.

It is another object of this invention to provide a carrying case having timed locking assemblies to store phones, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
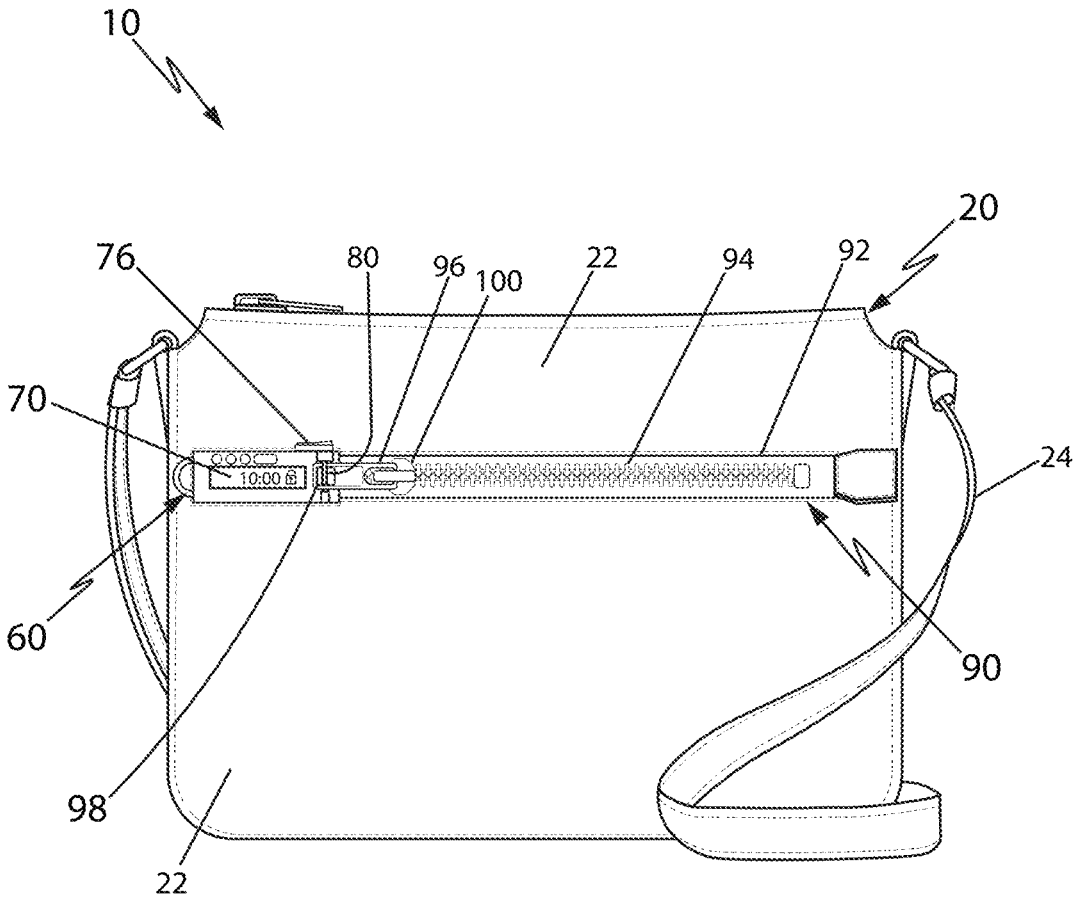
FIG. 1 is an isometric view of the present invention in a locked configuration.

Referring now to the drawings, the present invention is a carrying case having timed locking assemblies to store phones and is generally referred to with numeral 10. It can be observed that it basically includes case assembly 20, locking assembly 60, and at least one zipper assembly 90.

As seen in FIG. 1, locking assembly 60 and zipper assembly 90 are part of case assembly 20. Locking assembly 60 has integrated at least one zipper assembly 90.

Case assembly 20 comprises case 22 and handle 24. In a preferred embodiment, locking assembly 60 and zipper assembly 90 are positioned on case 22.

Zipper assembly 90 comprises zipper tape 92, teeth 94, and slider 100 having pull tab 96 with pull tab hole 98.

Figure 3:
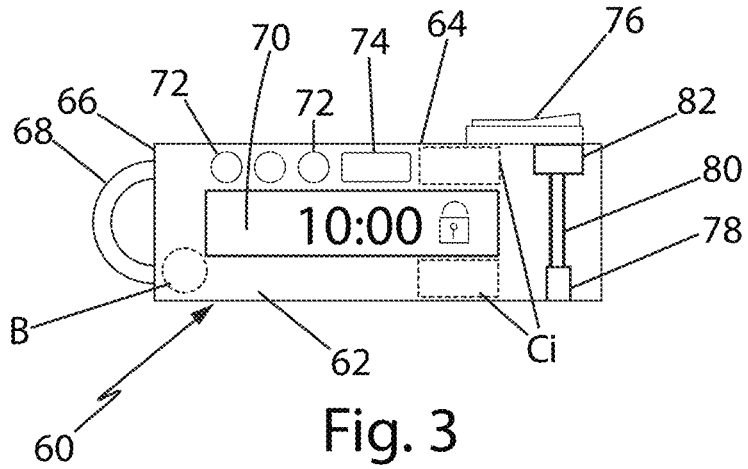
FIG. 3 is a front view of the locking assembly.
Figure 4:
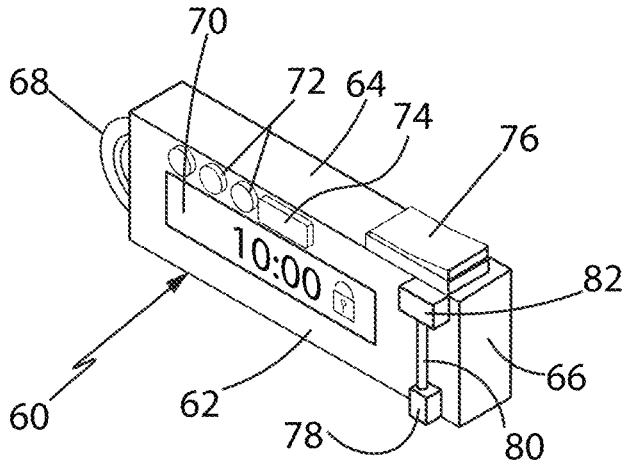
FIG. 4 is an isometric view of the locking assembly.

As seen in FIGS. 3 and 4, locking assembly 60 comprises front face 62, top face 64, and first and second lateral faces 66.

Locking assembly 60 further comprises battery B, electronic timer circuit and digital time circuit Ci. In a preferred embodiment, battery B is rechargeable, or can simply be replaced.

Front face 62 comprises screen 70, buttons 72, reset button 74, lower end 78, locking pin 80, and upper end 82. Top face 64 comprises locking tab 76.

Locking pin 80 is retractable and extends from lower end 78 to upper end 82. Locking pin 80 may be actuated automatically and manually.

First lateral face 66 comprises loop 68. Lower end 78 and upper end 82 with locking pin 80 are positioned close to second lateral face 66.

Screen 70 displays a timer and/or time, which is programed by buttons 72.

Figure 5:
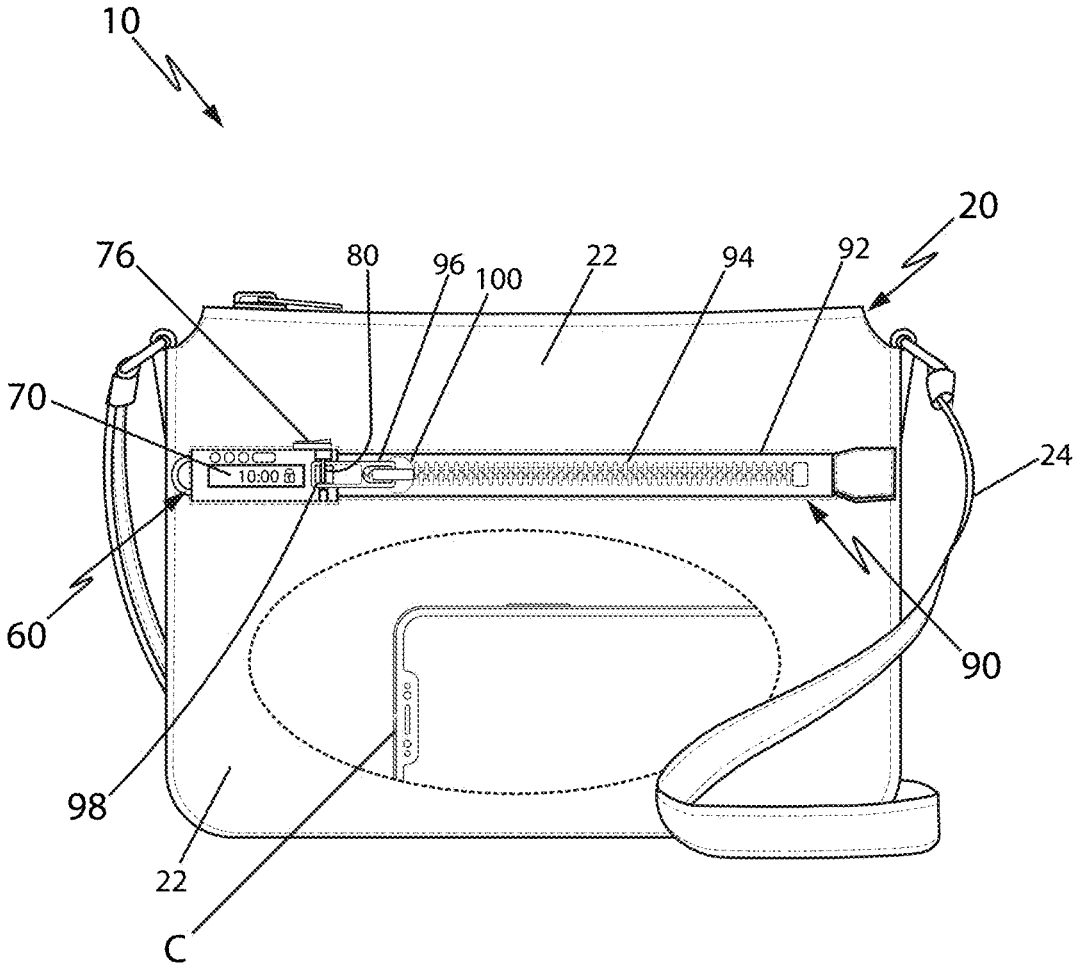
FIG. 5 is an isometric view of the present invention showing a cell phone inside.

As seen in FIG. 5, locking assembly 60 is attached in line to zipper tape 92 to receive pull tab 96.

In a locked configuration, locking pin 80 passes through pull tab hole 98 and upper end 82 receives locking pin 80 securing pull tab 96 on locking assembly 60.

Figure 2:
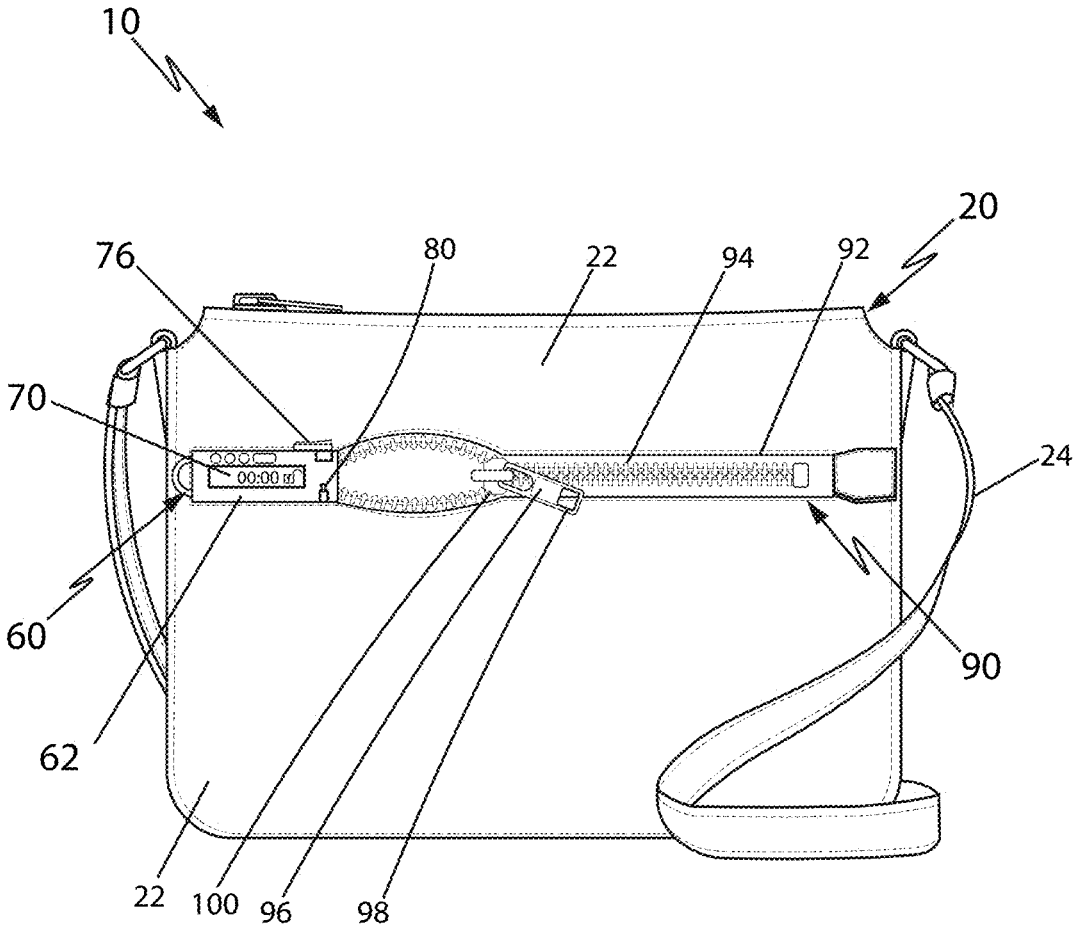
FIG. 2 is an isometric view of the present invention in an unlocked configuration.

In an unlocked configuration, as seen in FIG. 2, locking pin 80 is open toward lower end 78 releasing pull tab 96.

Locking pin 80 is actuated by locking tab 76. A predetermined time to keep zipper assembly 90 in the locked configuration is scheduled through buttons 72.

In a preferred embodiment, locking pin 80 releases automatically pull tab 96 when the predetermined time is completed.

In another embodiment, pull tab 96 is manually released through locking tab 76 when desires.

Case assembly 20 stores cell phone C. Zipper assembly 90 with locking assembly 60 in the locked configuration provides that an individual may schedule a time in which case 22 is locked avoiding or restricting the access to cell phone C or other electronic devices.

Figure 6:
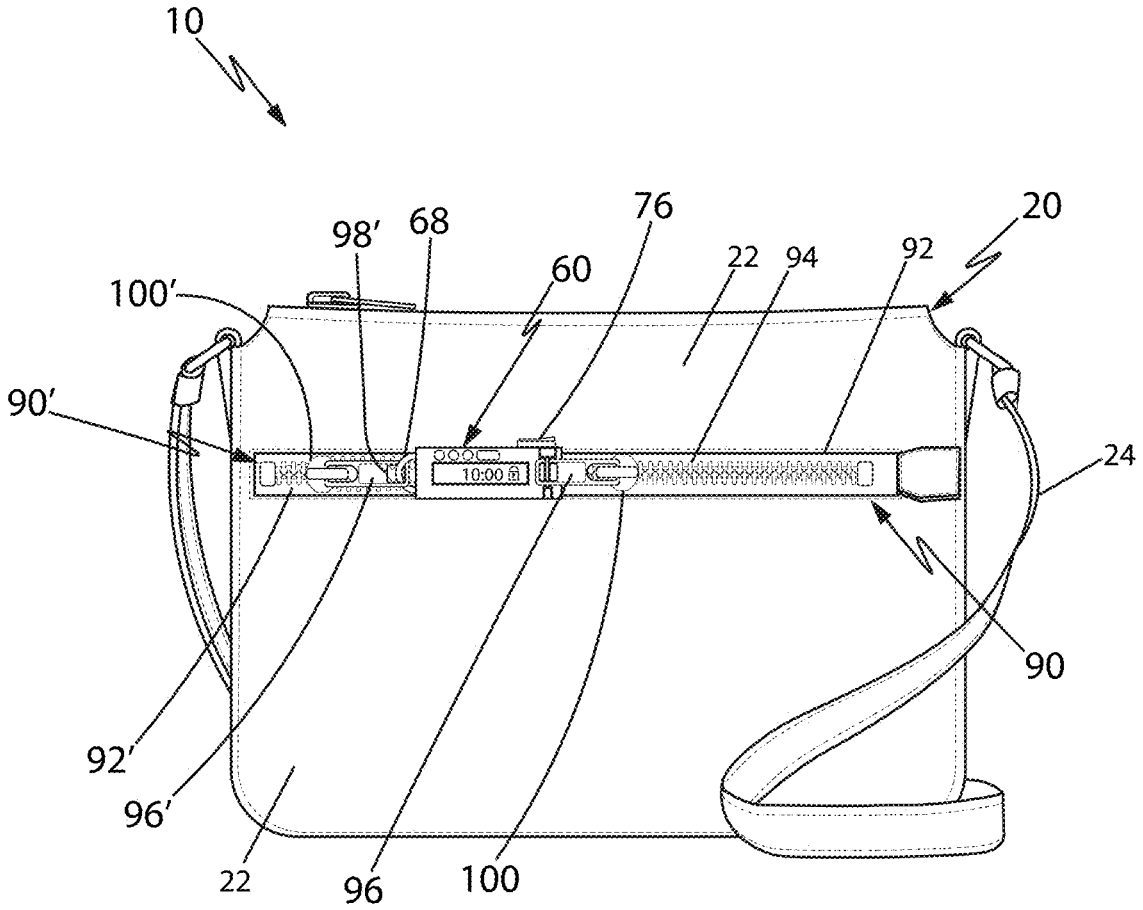
FIG. 6 is an isometric view of the present invention showing a double zipper assembly.

As seen in FIG. 6, in an alternative embodiment, case assembly 20 comprises locking assembly 60 having zipper assembly 90' connected to loop 68 at first lateral face 66 and second zipper assembly 90 extending from second lateral face 66. Both of first and second zipper assemblies 90 and 90' are locked by locking assembly 60. Zipper tape 92' has slider 100'. Slider 100' is attached to loop 68, whereby loop 68 receives pull tab hole 98 on pull tab 96.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A carrying case having timed locking assemblies to store phones, comprising:

A) a case assembly;

B) a locking assembly comprising a front flat face, a top flat face, first and second lateral flat faces, a battery, an electronic timer circuit, and a digital time circuit, wherein said front flat face comprises a screen, buttons, a reset button, a lower end positioned close to the second lateral flat face, a linear locking pin, positioned close to the second lateral flat face, and an upper end positioned close to the second lateral flat face, said flat top face comprises a locking tab positioned close to the second lateral flat face, said screen displays a time or a timer, which is programed by said buttons, said first lateral flat face comprises a loop; and C) at least one zipper assembly integrated to said locking assembly, wherein said zipper assembly and said locking assembly are part of said case assembly, wherein said zipper assembly comprises a zipper tape, teeth, and an slider having a pull tab with a pull tab hole, wherein in a locked configuration said linear locking pin passes through said pull tab hole and said upper end receives said linear locking pin securing said pull tab on said locking assembly;

said locking assembly comprises a first zipper assembly connected to said loop at said first flat lateral face and a second zipper assembly extending from said second flat lateral face, whereby both of said first and second zipper assemblies are locked by said locking assembly.

2. The carrying case having timed locking assemblies to store phones set forth in claim 1, wherein said linear locking pin is retractable and extends from said lower end to said upper end.

3. The carrying case having timed locking assemblies to store phones set forth in claim 1, wherein said linear locking pin is actuated automatically and manually.

4. The carrying case having timed locking assemblies to store phones set forth in claim 1, wherein said locking assembly is integrated to said zipper assembly, whereby said locking assembly is attached in line to said zipper tape to receive said pull tab.

5. The carrying case having timed locking assemblies to store phones set forth in claim 1, wherein in an unlocked configuration said linear locking pin is open toward said lower end releasing said pull tab.

6. The carrying case having timed locking assemblies to store phones set forth in claim 1, wherein said linear locking pin is actuated by said locking tab.

7. The carrying case having timed locking assemblies to store phones set forth in claim 1, wherein a predetermined time to keep said zipper assembly in said locked configuration is scheduled with said timer through said buttons.

8. The carrying case having timed locking assemblies to store phones set forth in claim 7, wherein said linear locking pin releases automatically said pull tab when said predetermined time is completed.

9. The carrying case having timed locking assemblies to store phones set forth in claim 7, wherein said pull tab is manually released through said locking tab when desires.

10. The carrying case having timed locking assemblies to store phones set forth in claim 7, wherein said case assembly stores a cell phone.

11. The carrying case having timed locking assemblies to store phones set forth in claim 10, wherein said zipper assembly with said locking assembly in said locked configuration avoid the access to said cell phone inside a case for said predetermined time.

* * * * *